US008821072B2

(12) United States Patent
Ditillo

(10) Patent No.: US 8,821,072 B2
(45) Date of Patent: Sep. 2, 2014

(54) GROUND DRILLING METHOD AND APPARATUS

(75) Inventor: Alessandro Ditillo, Cesena (IT)

(73) Assignee: SOILMEC S.p.A., Cesena (FC) (IT)

( * ) Notice: Subject to any disclaimer, the term of this patent is extended or adjusted under 35 U.S.C. 154(b) by 62 days.

(21) Appl. No.: 13/336,637

(22) Filed: Dec. 23, 2011

(65) Prior Publication Data

US 2012/0163921 A1 Jun. 28, 2012

(30) Foreign Application Priority Data

Dec. 23, 2010 (IT) ..... 2010A1047

(51) Int. Cl.

| | |
|---|---|
| ***E02D 11/00*** | (2006.01) |
| ***E02D 7/22*** | (2006.01) |
| ***E21B 44/00*** | (2006.01) |
| ***E21B 7/20*** | (2006.01) |

(52) U.S. Cl.

CPC . *E02D 7/22* (2013.01); *E21B 44/00* (2013.01); *E21B 7/201* (2013.01)

USPC ..... 405/232

(58) Field of Classification Search

CPC .... E02D 11/00; E02D 7/22; E02D 2250/0038

USPC ..... 405/232; 175/45, 50

See application file for complete search history.

(56) References Cited

U.S. PATENT DOCUMENTS

| | | | | |
|---|---|---|---|---|
| 4,844,661 A * | 7/1989 | Martin et al. | ..... | 405/232 |
| 6,033,152 A | 3/2000 | Blum | | |

FOREIGN PATENT DOCUMENTS

| | | | |
|---|---|---|---|
| CN | 1944939 A | * | 4/2007 |
| EP | 1 277 887 | | 1/2003 |
| EP | 1 942 247 | | 7/2008 |
| JP | 5-086791 | | 4/1993 |
| JP | 09125854 A | * | 5/1997 |
| JP | 11036767 A | * | 2/1999 |

OTHER PUBLICATIONS

Italian Search Report for Application No. TO 2010 A 001047 mailed Nov. 22, 2011.

* cited by examiner

*Primary Examiner* — Benjamin Fiorello
*Assistant Examiner* — Kyle Armstrong
(74) *Attorney, Agent, or Firm* — Merchant & Gould P.C.

(57) ABSTRACT

An apparatus for drilling the ground, in particular for the installation of foundation piles, includes a drilling turret (2) with a vertical guiding antenna (3), a rotary head for driving drilling batteries including a continuous ground drilling rotary propeller (5) housed inside at least one covering tube (7). A inner drive is adapted to drive said propeller (5), and a second external drive is connected to the tube (7) and allowing movement thereof, a driving cab (8) for an operator, which includes all the manipulators for operating the machine and the systems for displaying measured parameters. The apparatus further includes a system for controlling the excavation parameters, which is enabled to receive information from the drilling parameter control sensors.

8 Claims, 4 Drawing Sheets

GROUND DRILLING METHOD AND APPARATUS

This application claims benefit of Serial No. TO 2010 A 001047, filed 23 Dec. 2010 in Italy and which application is incorporated herein by reference. To the extent appropriate, a claim of priority is made to the above disclosed application.

BACKGROUND

The present invention relates to a method and an apparatus for drilling the ground, wherein the actual energy required by the drilling process is calculated by measuring drilling parameters. Said method is applicable, in particular, to the installation of foundation piles in the ground.

In particular, the present invention relates to a method and an apparatus for the installation of piles in the ground in accordance with the CAP (Cased Augered Piles) and CSP (Cased Secant Piles) technologies. These technologies employ an excavation equipment consisting of a continuous ground drilling propeller housed inside a covering tube, the main purpose of which is to stabilize the borehole walls and to allow advancement into particularly hard ground.

In general, said equipment comprises a drilling machine like the one shown in FIG. 1, which is typically tracked and comprises a drilling turret 2 with a vertical guiding antenna and at least one rotary head for driving drilling batteries, which are slideable along the antenna and are driven by a mechanism (generally a rope mechanism) capable of exerting a pull and a thrust onto the batteries.

First inner drive means 9 are connected to a propeller battery 5, and second independent external drive means 10 are connected to tube 7, for the purpose of selectively rotating the two elements. In the most common configuration, the inner drive means 9 belong to a higher first rotary head 4, whereas the external drive means 10 are connected to a lower second rotary head 6. The propeller and the tube are preferably rotated in a discordant manner, preferably the tube rotating counterclockwise and the propeller rotating clockwise. The propeller and the tube can move axially relative to each other by means of suitable selective drive means.

The main function of the covering tube is to stabilize the borehole walls and to allow advancement into particularly hard ground while maintaining a high degree of borehole verticality. The covering hole is also fitted with excavating teeth at the bottom edge to bite the ground in the annular excavation portion. The rotations must advantageously occur in opposite directions to allow the ground to climb up along the propeller because of the inner friction between the material and the tube wall, to be then discharged in the upper part of the covering tube.

The excavation equipment further comprises a driving cab 8 for an operator, which includes all the manipulators for operating the machine and the systems for displaying and controlling the most important parameters.

It is known that installing foundation piles in the ground, and in particular drilling the holes for such piles, is easier when the type of ground involved is known. One possible way of knowing the characteristics of the ground is to make preliminary drillings in the excavation site. This procedure is not always compatible with the time available. Moreover, making a preliminary drilling for each excavation would imply significantly higher costs. It is therefore necessary to be able to deduce the characteristics of the ground while the actual drilling work is being carried out. Thanks to the sensors available on the operating machine, it is possible to make real-time analyses to interpret the characteristics of the ground being drilled.

Patent EP1942247 describes a method and a device for compaction drilling, wherein a drilling tool is fed into the ground through the effect of the thrust and rotation generated by suitable means.

The operating drilling parameters (torque, revolution speed, descent speed per revolution, constituting the alpha and thrust parameters) are measured during the drilling process and are simultaneously sent to a computer, which correlates them mathematically to determine the load capacity of an "ideal" pile cast into the borehole just drilled. In order to evaluate the load capacity of the borehole, the system calculates the load capacity characteristic, called $\alpha$, and enters it into a previously prepared table containing data relating to drilling tests previously carried out in grounds having known characteristics. This ground type estimation also allows establishing the final depth of the pile to be made as a function of the measured values.

SUMMARY

The present Applicant observed that the method described in said document is not effectively applicable to machines operating in accordance with the so-called CAP and/or CSP technologies, in that the machine described therein does not include the external tube that envelops the drilling propeller.

As a matter of fact, the Applicant has perceived that machines of the type employed in the present invention are subject to internal interactions, which interactions are definitely non-negligible and may alter the value of the specific energy of drilling.

In addition, the tool shape is as long as the whole drilling depth, and the resulting frictions are distributed over large and non-negligible contact areas. This differs from what happens when normal excavation tools are used, the height of which is generally limited (they are not taller than 2 m), and which are driven by rods (also telescopic ones) that do not come in contact with the borehole walls.

In fact, in the CAP and/or CSP drilling processes the covering tube is filled with ground by the propeller. During the rotation of the two excavation batteries (tube and propeller), which, as aforementioned, rotate in opposite directions, heavy frictions are generated among the inner surface of the covering tube, the ground contained therein and the continuous propeller.

In order to overcome these frictions, the operating machine must output more torque to the rotary heads, as well as stronger pull or thrust axial forces, if relative axial movements are also desired between the covering tube and the propeller.

In CAP and/or CSP drilling, the specific energy of drilling measured by the sensors is therefore given by the sum of three contributions due to:

- external frictions, which are generated by contact between the outer wall of the tube and the ground forming the borehole surface.
- internal frictions, which are generated by contact between the inner wall of the tube, the excavated ground and the propeller.
- frictions and resistances at the excavation front, which are generated by contact of the bottom edges of the tube and of the propeller being driven into the ground.

It is the object of the present invention to provide a method and an apparatus for the installation of piles in the ground, wherein drilling parameters are measured which allow to evaluate the specific energy of drilling and then to determine the ground resistance variations during the excavation.

BRIEF DESCRIPTION OF THE DRAWINGS

An exemplifying but non-limiting embodiment of the present invention will now be described with reference to the annexed drawings, wherein.

DETAILED DESCRIPTION

Figure 1:
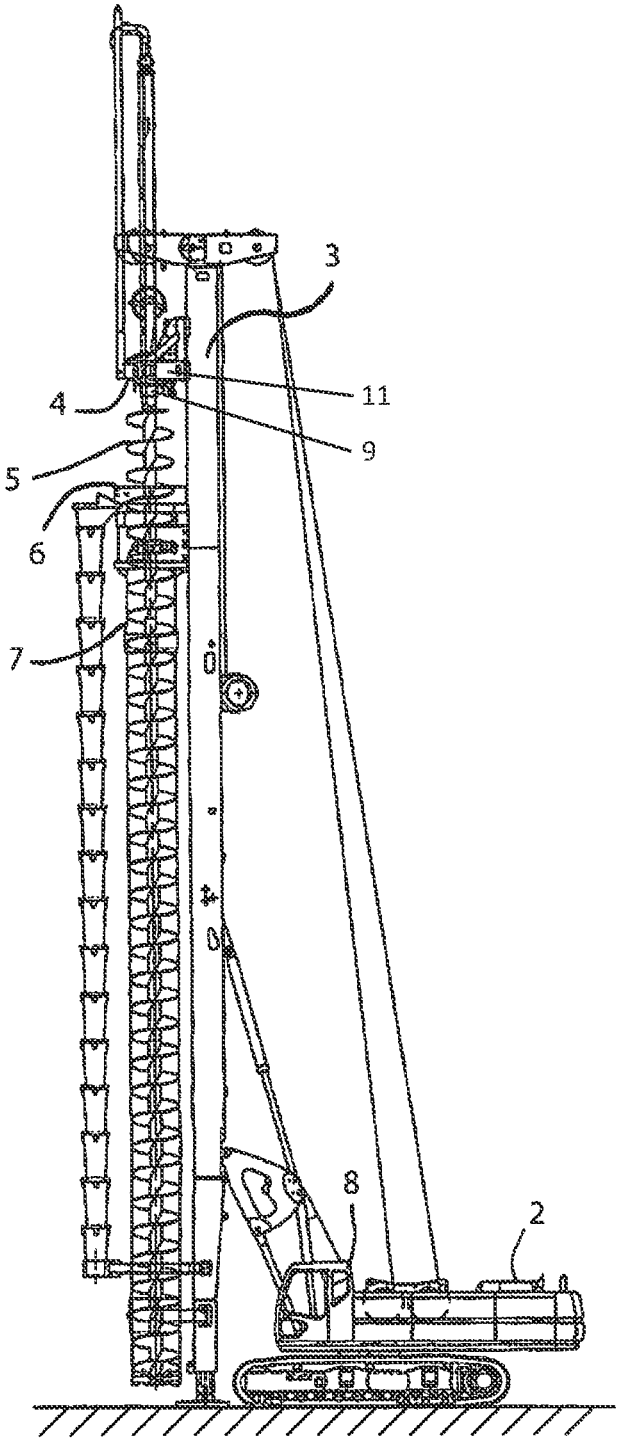
FIG. 1 shows the excavation equipment with the drilling battery fully lifted.
Figure 2:
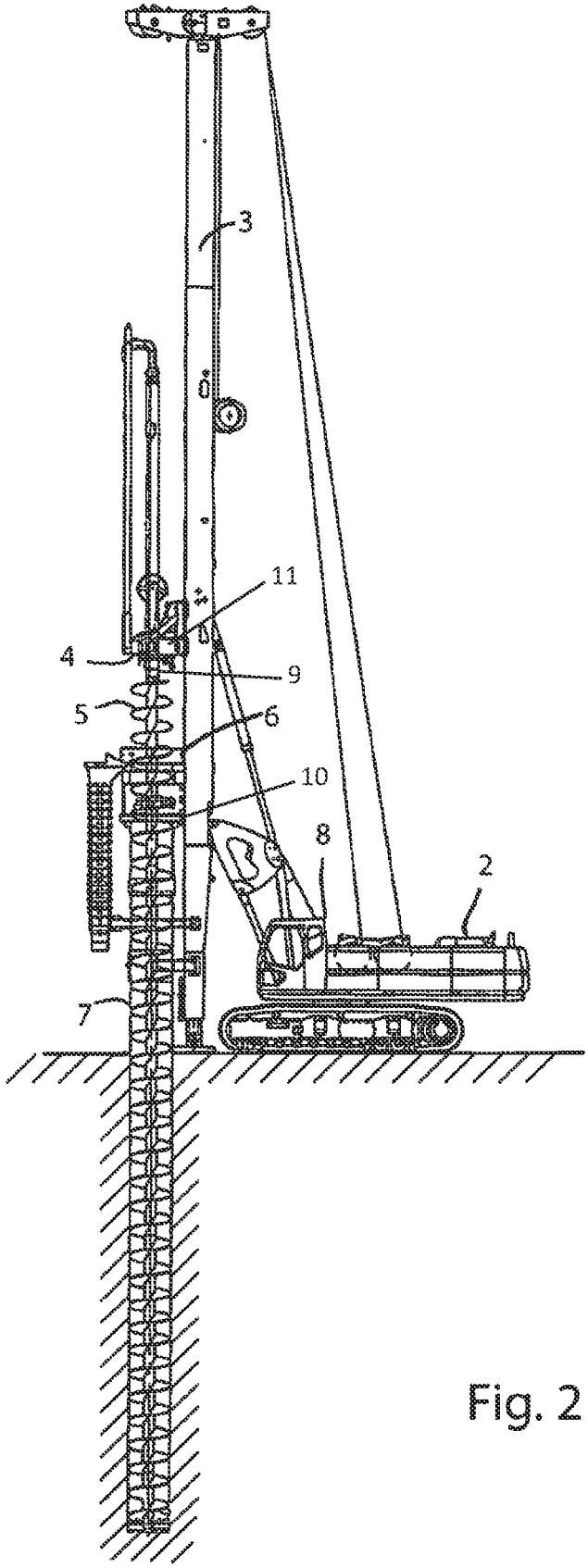
FIG. 2 shows the excavation equipment with the drilling battery partially driven into the ground.

With reference to the above-mentioned drawings, the drilling equipment according to the present invention essentially comprises at least one drilling turret 2 with a vertical guiding antenna 3, and at least one rotary head for driving the drilling batteries. Said batteries comprise at least one continuous ground drilling rotary propeller, housed inside a covering tube 7.

First inner drive means 9, or a higher first rotary head 4, are adapted to drive said propeller 5, while second independent external means 10, or a lower second rotary head 6, are connected to tube 7 and allow movement thereof.

The propeller and the tube can rotate and move axially relative to each other in a selective and independent manner. The equipment further comprises a driving cab 8 for an operator, which includes all the manipulators for operating the machine and the systems for displaying the measured parameters.

To implement the present invention, the equipment comprises an excavation parameter control system (e.g. a PLC, a computer or, more generally, a data processing unit), which is enabled to receive information from drilling parameter control sensors 11. Said sensors 11 preferably comprise torque sensors, pull-thrust sensors, revolution speed sensors, advancement speed sensors and depth sensors.

In particular, the system is enabled to store data received from the sensors 11, which data is subjected to mutual or time-based correlation. To this end, the control system comprises a database storing the data measured by the equipment.

The system compares the current data with the data stored in the database, and returns the actual values of the measurements, whether direct or indirect (i.e. obtained through formulas), necessary for knowing in advance the characteristics of a portion of ground involved in the excavation.

The excavation parameter control system can display and/or create graphs of said parameters in the course of the excavation and/or offers the possibility of exporting this information to allow it to be treated through external means (e.g. computer, palmtops, iphone, ipad, etc.).

Furthermore, the system can warn the operator when any one of said parameters changes very rapidly and reaches anomalous values beyond a certain user-defined threshold.

The propeller and the tube are rotated in a discordant manner, preferably the tube rotating counterclockwise and the propeller rotating clockwise. The propeller and the tube can be moved axially relative to each other through suitable selective drive means.

The main purpose of the covering tube is to stabilize the borehole walls and to allow advancement into particularly hard ground. The covering tube is also fitted with excavating teeth at the edge to bite the ground in the annular portion. The rotations must take place in opposite directions to allow the ground to climb up along the propeller, due to the internal frictions between the material and the tube wall, to be then discharged in the upper part of the covering tube.

The specific energy of drilling, introduced in the industry by Paone (1963) and Tale (1965), expresses the quantity of energy, in kJ, that must be spent in order to remove a predetermined quantity of ground, equal to 1 $m^3$, by drilling.

The formula of the specific energy of drilling is the following:

$$E = \frac{F}{A} + \frac{2\pi NT}{AR}, \tag{1}$$

which calculates the specific energy of drilling E $kJ/m^3$;

on the basis of the following drilling parameters, measured by sensors of the equipment:

T=Actual torque acting upon the rods kN·m;

F=Actual thrust acting upon the tool kN;

N=Revolution speed of the rods (and of the tool) rpm;

R=Drilling advancement speed m/min, whereas the plan area (A) of the tool, i.e. the cross-section of the hole, expressed in $m^2$, is known a priori.

In order to carry out said overall measurement with the above-described equipment, it is therefore necessary to take into account the effect of internal frictions in the CAP and/or CSP equipment and to correct the measurement of the specific energy of drilling accordingly. In order to know how much energy is spent for internal frictions, it is appropriate to separate this latter contribution from the other ones.

In fact, according to a logic method that could be followed in order to measure the main drilling parameters for the purpose of obtaining the energetic expense of the excavation, one could attribute to each one of the two batteries (tube and propeller) a specific energy calculated by using the formula (1).

Taking into account the interactions between the two drilling batteries, it will be necessary to apply a corrective factor to determine the actual energetic expense of the single batteries, and hence the total energy actually required.

According to one aspect of the present invention, one method for evaluating the component of internal interaction between the two drilling batteries (propeller and tube) is to fill the tube with the propeller, so as to simulate the actual behaviour at the end of the excavation, and then to carry out measurements in such conditions by means of the sensors.

Groundless values will first be measured, so as to determine the energetic characteristics dispersed by the machine, while also taking into account the actual design of the tube and propeller in use, which from case to case may have different tolerances and dimensions, and hence be subject to different friction losses and provide different performance levels, which cannot be easily determined beforehand. It must be pointed out that one such machine can operate within an excavation diameter range of 400 mm to 1,200 mm and, as a consequence, the frictions (which are proportional to the lateral area of the tube) will be very different and will have to be correlated with the actual excavation diameter and length.

Once a certain battery diameter has been established, one may, in successive steps (e.g. FIGS. 4*a*-4*d*), partially fill the propeller with a material M by excavating normally (e.g. in steps of 1 m of depth), extract it from the borehole along with the tube, and finally, once the propeller is out, determine the torque-thrust characteristics required to keep the extracted ground in rotation, e.g. by turning the inner propeller and holding the outer tube. These parameters can be determined for both the propeller and the tube by driving them separately; it follows that by turning the tube and holding the propeller it is possible to determine the same "loadless" parameters originated by the external drive means. As depth increases, the ground contained in the excavation batteries increases as well, resulting in higher "loadless" torque and thrust values.

When measuring the tube parameters, one may either hold the propeller or put it in motion (in the opposite direction, as in the actual operating conditions) to prevent the material contained therein from descending. In this second case, it will be necessary to take into account the lifting effect exerted by the propeller onto the ground contained therein (auger effect) and, if the ground climbs up along the propeller plane, it will be necessary to take into account the torque contributions due to the internal friction between the ground and the top surface of the helical plane.

Such "loadless" measurements must first be carried out with a completely empty tube, thus simulating the beginning of excavation, and so on until the maximum depth conditions are simulated (end of excavation), i.e. with the tube completely filled.

During the actual drilling work, starting from said "loadless" measurements and knowing the (average and instantaneous) advancement speed, the propeller and tube revolution speeds, and the "loadless" torque and thrust characteristics, one can determine the step-by-step drilling energy contribution spent for the interaction, so that it can be represented by a diagram, e.g. as a function of depth and/or time.

By subtracting the "loadless" torque and thrust values due to the internal interaction from the torque and thrust values recorded for the two batteries, it is then possible to determine the value of the specific energy of drilling actually spent to go through a certain ground, already purged from the internal interaction.

This actual value can be useful to determine the real characteristics of the ground or to analyze the design modifications required for facing any undesired and unexpected conditions when carrying out the excavation.

Having determined the correspondence between the type of ground contained in the propeller and the values of the "loadless" parameters, one can use the maximum values, relating to a full propeller, when, for example, the next drilling operation is carried out without first emptying the propeller. As a matter of fact, since the first hole is started with clean batteries, in that case the propeller is loaded progressively in a manner proportional to the depth reached, whereas the second hole can be started with a clean battery (if the operator empties the propeller completely at the end of each drilling operation) or with a partially or completely full battery (so long as the conditions of stability of the equipment allow).

In short, the method according to the present invention requires a "loadless" measurement of the drilling parameters in order to be able to calculate the energy necessary for rotating the drilling battery.

Said "loadless" measurement (taken with the drilling battery out of the ground) comprises a step of measuring said parameters with the space between the propellers and the tube empty or void of material, followed by a step of measuring said parameters at least once with a predetermined intermediate quantity of material therein, so as to simulate the excavation process in an intermediate position. Finally, this "loadless" measurement preferably also comprises a step of measuring said parameters with the space between the propellers and the tube completely filled with material, thus simulating the end-of-excavation conditions.

After having calculated said loadless energy, it is possible to proceed with the excavation by driving the drilling battery into the ground and, during this actual excavation step, to measure the actual drilling parameters and then subtract therefrom the loadless values previously measured to calculate the actual energy required for carrying out the excavation, thus obtaining information about the actual consistency of the ground.

The "loadless" drilling parameter measurement step should include the possibility of filling the space between the propeller and the tube with a material similar to that of the drilling site.

Figure 3:
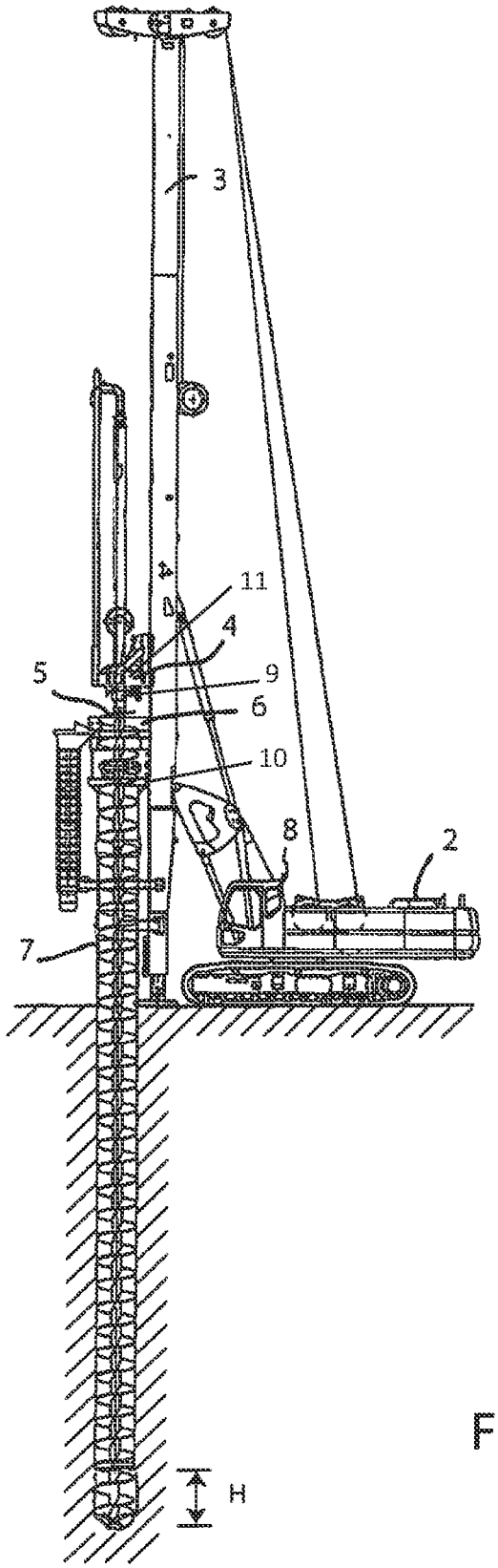
FIG. 3 shows the excavation equipment with the drilling battery partially driven into the ground and the drilling propeller advanced with respect to the tube.
Figure 4D:
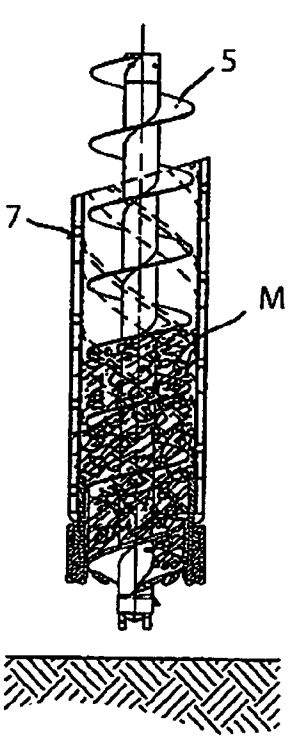
FIGS. 4A-4D show the end portion of the drilling battery in the loadless condition and with one, two and three layers of material between the propeller and the tube, respectively.
Figure 4C:
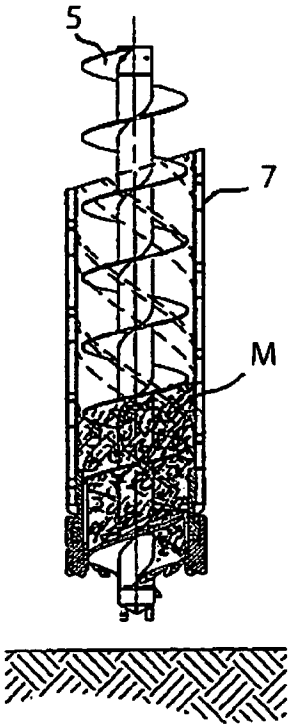
Figure 4B:
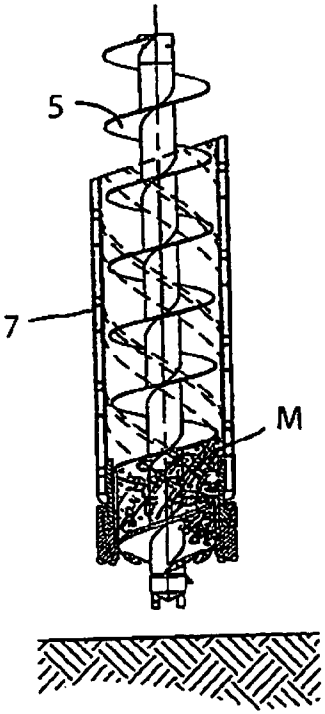
Figure 4A:
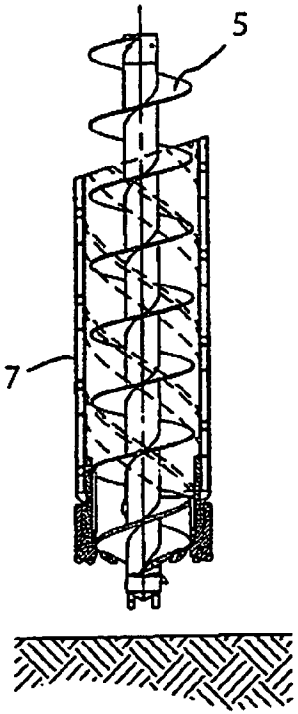

According to a further peculiar aspect, the present invention provides for executing a ground drilling operation with the drilling battery by placing the propeller at a predetermined height advanced with respect to the tube, e.g. by 0.1 m-1 m. By operating the inner propeller only and holding the tube, it is possible to control the main excavation parameters (torque, revolution speed, advancement speed and required thrust) and to calculate the total energy required for the drilling operation, in order to obtain information about the actual consistency of the ground. The drilling operation carried out by the propeller will end at the preset depth (H in FIG. 3), obtained by imposing a predetermined value (to be recorded), e.g. by correlating it with the excavation diameter and imposing a predefined volume (e.g. one cubic meter) for the testing step.

In this particular case, if one wants to determine the characteristics of the ground by advancing the propeller only, it is not necessary to get out of the borehole to determine the "loadless" characteristics, since it will suffice to determine those characteristics belonging to the propeller. The necessity of getting out of the borehole to determine the "loadless" parameters only arises when one wants to determine the values pertaining to the tube, which, if it were kept inside the borehole, would be affected by internal frictions caused by the propeller and the ground as well as by external frictions generated between the tube and the ground.

At this point, by lifting the propeller in order to, for example, bring it again inside the tube, the torque values and the axial forces involved can be measured in order to obtain a "loadless" measurement of these characteristics as well, with also the ground inserted in the space between the propeller and the tube. In this case, it is necessary to avoid any contact between the tip of the propeller and the ground, as well as any lateral contact (if present) between the propeller and the borehole.

The excavation tool can be configured in both the propeller and the tube. By analyzing the very elongated shape of the tube, it becomes apparent that it is affected by lateral friction against the borehole walls, and therefore that the energy required for moving it increases with depth. To determine this contribution, one can lift the tube tip a little from the borehole bottom to avoid any head contact, and then rotate in the same manner both the tube and the propeller (so as to have no relative internal movement) to only read the contribution due to external friction. Should it be impossible to rotate both batteries integrally, one may rotate the tube and then subtract the "loadless" contribution previously determined with the measurement taken outside the borehole. At this point, knowing the contribution due to internal and external frictions, the contribution at the bottom excavation face can be determined by measuring the parameters as the tube advances.

If from this moment onwards the tube alone were advanced, we would simply determine the contribution of the internal and external lateral friction due to the height variation. By adding it to the bottom face contribution, we could determine the value of the specific energy spent to advance the tube (connected to the volume equal to the product of the annular area defined by the cutting thickness of the tube crown by the excavation height at which the parameters have been measured).

By continuing to monitor the drilling parameters and knowing the "loadless" parameters, it is also possible to verify the state of the excavated ground inside the tube. In fact, the generation of ground-related frictions depends on the ground's nature (e.g. its degree of adhesiveness) and on the presence or absence of water (e.g. water added during the excavation or met when crossing a water-bearing stratum). However, in the event that stones, pebbles or bigger rocks should get stuck between the propeller and the tube, then the motion resistance will increase accordingly; therefore, by monitoring the torque absorbed with the propeller not advanced with respect to the tube and by comparing this value with the "loadless" parameters, it will be possible to determine whether an anomalous friction condition is taking place or not.

The present invention allows to determine the actual excavation parameters when more than one battery is used, as well as to determine the specific energy of drilling when elongated batteries are employed.

It is also possible to correctly measure the specific energy value for crossing a certain ground layer, because one can know in real time the typologies of the materials to be drilled and the actual value of the specific energy spent for the excavation, purged from any losses, frictions and inefficiencies of the machine and of the drilling batteries. Through the measurement of the energy required for rotating the tube, by keeping it partially lifted from the excavation front it is possible to determine the progression of the frictions during the descent and to put it in relation with depth. Knowing the lateral area at the depth reached and the torque purged from the "loadless" contribution, one can determine the mean friction values acting between the tube and the excavation walls. The knowledge of the actual values required and of the actual losses due to friction in the system can be useful in view of future developments aiming at improving the performance of the drive systems, supply systems and tools. This may also help choosing in advance the most suitable tools (e.g. ratio between propeller and tube diameters, with the associated clearances, for which the database of "loadless" and excavation values may suggest the most appropriate combinations or those combinations which will avoid any blockage problems caused by large debris, stones or rock pieces getting stuck), or even the best rotary head with the proper torque output for the work to be carried out (taking into account the actual losses). This is an essential parameter because, once the maximum torque has been set, the available power output of the plant being equal, a torque reduction leads to a higher revolution speed. It follows that, once the correct range of torque values has been defined, it will be possible to always use the maximum power, with increased productivity as a result.

The shape of the equipment is not binding, and mechanical variations in the architecture of the machine will not constitute a substantial differentiation. For example, devices are known in the industry which are only fitted with one rotary head having two rotary outputs (internal and external drive means), to which the propeller and the tube must be connected. These systems feature limited axial displacement (typically 400 mm, obtained through a jack connecting the inner battery to the rotary head, integral with the tube), but nonetheless these types of rotary heads allow the batteries to be counter-rotated, selectively and independently operated and reciprocally advanced, thus allowing the above-described measurements to be taken.

The invention claimed is:

1. A method for drilling the ground with excavation equipment for installation of foundation piles, said excavation equipment comprising:

at least one drilling turret with a vertical guiding antenna;

at least one rotary head for driving drilling batteries, the drilling batteries comprising at least one continuous ground drilling rotary propeller housed inside a covering tube;

first inner drive means adapted for driving said propeller;

second external drive means connected to the tube and allowing movement of the tube;

the propeller and the tube being capable of rotating and moving axially relative to each other in a selective and independent manner;

a driving cab for an operator, including:

all manipulators for operating the excavation equipment, and systems for displaying and controlling measured parameters, sensors adapted to measure drilling parameters;

said method comprising the following steps in sequence:

excavating by drilling the ground and creating a borehole by extending the propeller and the tube to a predetermined depth;

determining a preset depth at which the drilling operation carried out by the propeller ends, said preset depth being obtained by correlating said preset depth with a propeller excavation diameter and a predetermined volume of soil to be excavated;

continuing excavation by rotating and advancing only the propeller with respect to the tube while holding the tube stationary;

measuring said drilling parameters of said propeller and said tube;

terminating the rotating and the advancing of the propeller when the propeller protrudes from the tube at the preset depth;

determining total energy required by the drilling method, and determining actual specific energy of drilling as a function of energy required to overcome frictions associated with drilling into the ground by subtracting energy contributions of previously determined loadless measurements from the total energy to obtain information about consistency or density of the ground.

2. The method according to claim 1, wherein determining loadless measurements comprises the steps of:

lifting the propeller up to bring the propeller at least partially inside the tube, and measuring loadless drilling parameters after said lifting step.

3. The method according to claim 1, wherein said loadless measurement step comprises:

putting in rotation either the propeller or the tube, or both, with the drilling battery out of the ground, measuring said drilling parameters with the space between the propeller and the tube void of material, measuring said drilling parameters at least once with a predetermined intermediate quantity of material inside of the space to simulate the excavation step in an intermediate position.

4. The method according to claim 3, wherein said loadless measurement step comprises measuring said drilling parameters with the space between the propeller and the tube completely filled with material, while putting either the propeller or the tube, or both, in rotation.

5. The method according to claim 1, wherein the loadless measurements are determined by the steps of:

lifting a bottom tip of the tube from the bottom of the hole, so as to avoid any head contact, and rotating in the same manner both the tube and the propeller, and measuring the drilling parameters and calculating the value of the energy required for overcoming the external friction between the tube and a borehole.

6. The method according to claim 1, wherein said drilling parameters are chosen among the following group of parameters: torque, pull-thrust, revolution speed, advancement speed and depth reached.

7. Apparatus for drilling ground for installation of foundation piles, comprising:

at least one drilling turret with a vertical guiding antenna, at least one rotary head for driving drilling batteries, the drilling batteries comprising at least one continuous ground drilling rotary propeller housed inside at least one covering tube;

first inner drive means adapted for driving said propeller, second external drive means connected to the tube and allowing movement of the tube;

a driving cab for an operator, the driving cab including all manipulators for operating the apparatus and further including systems for displaying and controlling measured parameters;

a system for controlling drilling parameters of the propeller and the tube, the system being configured to receive information from drilling parameter control sensors;

wherein said propeller and said tube can move axially relative to each other, the ground being drilled to create a borehole with the propeller and the tube being extended to a predetermined depth at which the drilling by the propeller ends, the predetermined depth being determined by correlating the predetermined depth with a propeller excavation diameter and a predetermined volume of soil to be extracted; the apparatus configured to continue excavation with only the propeller being rotated and advanced with respect to the tube, while the tube is held stationary, and said drilling parameter are measured until the propeller protrudes from the tube to the predetermined depth, and total energy necessary for carrying out drilling, and to determine actual specific energy of drilling as a function of energy required to overcome frictions associated with drilling into the ground by subtracting energy contributions of previously determined loadless measurements from the total energy to obtain information about consistency or density of the ground.

8. The apparatus according to claim 7, wherein said control sensors are chosen among the following group of sensors: torque sensors, pull-thrust sensors, revolution speed sensors, speed sensors, advancement sensors and depth sensors.

* * * * *